US008887414B2

(12) United States Patent
Baker

(10) Patent No.: US 8,887,414 B2
(45) Date of Patent: Nov. 18, 2014

(54) DYNAMIC DAMPENING OF WIRE ROPE

(75) Inventor: Samuel John Andrew Baker, Beijing (CN)

(73) Assignee: Harnischfeger Technologies, Inc., Wilmington, DE (US)

( * ) Notice: Subject to any disclaimer, the term of this patent is extended or adjusted under 35 U.S.C. 154(b) by 330 days.

(21) Appl. No.: 13/531,765

(22) Filed: Jun. 25, 2012

(65) Prior Publication Data

US 2013/0340299 A1 Dec. 26, 2013

(51) Int. Cl.
*E02F 3/48* (2006.01)

(52) U.S. Cl.
USPC ..... 37/394; 254/392

(58) Field of Classification Search
USPC ..... 37/394, 395, 396, 397, 398, 399, 400, 37/401; 254/273, 392
See application file for complete search history.

(56) References Cited

U.S. PATENT DOCUMENTS 3,343,810 A * 9/1967 Parnell ..... 254/273
3,708,152 A * 1/1973 Bulin ..... 254/327
3,912,230 A * 10/1975 Learmont ..... 254/336
4,742,993 A * 5/1988 Montgomery et al. ..... 254/389
4,958,805 A * 9/1990 Willamsson ..... 254/332
5,014,829 A * 5/1991 Hare, Sr. ..... 188/267.1
5,226,249 A * 7/1993 Pippins ..... 37/396
5,845,893 A * 12/1998 Groves ..... 254/389
5,984,586 A * 11/1999 Wudtke ..... 405/224
6,401,370 B1 * 6/2002 Blom et al. ..... 37/396
7,024,806 B2 * 4/2006 Suzik et al. ..... 37/396
7,380,742 B2 * 6/2008 Stevens ..... 242/397.3
2007/0000732 A1 * 1/2007 Kulak et al. ..... 187/346

* cited by examiner

*Primary Examiner* — Jamie L McGowan
(74) *Attorney, Agent, or Firm* — Michael Best & Friedrich LLP

(57) ABSTRACT

A machine includes a base, a main housing that is freely rotatable and supported on the base. The main housing includes a generally horizontal surface. The machine also includes a drum mounted on said main housing, a boom extending from said main housing, a bucket operatively connected to and supported by the boom, a wire rope extending between the drum and the bucket for movement of the bucket, a fairlead disposed on the main housing along a path of the wire rope. The wire rope passes through the fairlead between the drum and the bucket. A dynamic dampening mechanism is disposed on the fairlead, the dynamic dampening mechanism including a dampening fluid having a variable viscosity in response to an electrical current applied thereto.

18 Claims, 3 Drawing Sheets

DYNAMIC DAMPENING OF WIRE ROPE

BACKGROUND

The present invention relates to a dynamic damping control mechanism for wire rope used in operation of heavy earth-moving machine, such as draglines, and the like, as frequently used in mining operations and construction.

Wire rope is a fundamental component in heavy earth-moving equipment such as draglines and electric mining shovels. Wire rope is the mechanism by which a bucket is positioned for dragging and hoisting the payload in the dragline application, and hoisting and/or crowding in the shovel application. Wire rope can also be a mechanism by which engaged structures are supported (e.g. the boom or mast of a dragline or shovel). As such, optimizing wire rope life is of paramount importance to ensure equipment availability and reduce operational costs.

During operation of heavy earth-moving equipment such as a dragline, particularly in digging, wire ropes are subjected to stresses and shock loading that induce standing wave vibration in the wire rope. Left uncontrolled, the wire ropes undergo extreme excursions. The wire rope used on large surface mining equipment is often large diameter steel wire rope, up to 5.00" in diameter in some cases. This large diameter wire rope is very heavy, and oscillations and movement (or whipping) thereof without damping can cause substantial damage to the rope, the supporting rope sheaves and the supporting structures due to the high inertial loads of the whipping rope.

In a positional mode (e.g. during digging, lifting, and lowering of the bucket), drag rope (in the form of wire rope) exiting the fairlead at the swivel frame assemblies follows the position of the wire rope which are subjected to stresses and shock loading that induce standing wave vibration in the wire rope. Extreme excursions in the positional mode translate into interference with the wrapping of the wire rope on the drum or an intermediate sheave assembly and necessarily require large clearances around the rope path to avoid contact with surrounding structure and equipment.

In a suspension support mode, pronounced excursions are present in dragline equipment where the amount of unsupported length of wire rope is extensive and the unit weight of the wire rope is large. Extreme excursions in the suspension support mode translate to fatigue of the individual wire strands at respective points of connection. The excursions are especially pronounced in dragline equipment where the amount of unsupported length of wire rope is extensive and the unit weight of the wire rope is large.

Both conditions (fatigue of the wire strands and interference with wrapping on the drum and/or sheave) necessarily limit the manner in which the dragline equipment is designed and operated. In both wire rope modes (positional control and suspension support), it is highly desirable to dampen the oscillations in the rope. However, too much rope-movement damping or too little damping may result in similar detrimental effects.

Prior attempts to dampen the pivoting action of the two swivel sheave frames through which the wire ropes pass have included mounting a connecting member between the two swivel frames. A number of different connecting members have been utilized, including a fixed orifice hydraulic damper, a solid metal bar, large rubber donuts, and a large mining truck tire mounted between the two frames.

The conventional dampers being utilized have fixed damping characteristics and do not allow for adjustment of the dampening characteristics which can vary heavily due to changing loading conditions, operator input, environmental factors, and digging conditions, etc. Currently to change the damper characteristics to a different fixed damping force, the dampers need to be removed, disassembled, machined, reassembled, and reinstalled. This is not a very cost effective or timely solution. Further, conventional friction-type dampers rely on abrasion, which leads to wearing of materials which leads to inconsistent and variable damping characteristics over the life of the damper, as well as a constant degradation of the components. The wearing of these dampers requires maintenance on a continual basis. This maintenance is often neglected and the performance of the dampers suffers greatly. Likewise, the friction-type dampers do not provide as desirable of a dampening effect as a viscous fluid damper.

SUMMARY

Accordingly, an exemplary object of the present invention is to stabilize the pivoting motion of the two fairlead swivel frames by automatically changing damping characteristics thereof in real time to accommodate changing load conditions or upon an imminent arrival of a shock wave In one embodiment, a machine includes a base, a main housing that is freely rotatable and supported on the base. The main housing includes a generally horizontal surface. The machine also includes a drum mounted on said main housing, a boom extending from said main housing, a bucket operatively connected to and supported by the boom, a wire rope extending between the drum and the bucket for movement of the bucket, a fairlead disposed on the main housing along a path of the wire rope. The wire rope passes through the fairlead between the drum and the bucket. A dynamic dampening mechanism is disposed on the fairlead, the dynamic dampening mechanism including a dampening fluid having a variable viscosity in response to an electrical current applied thereto.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
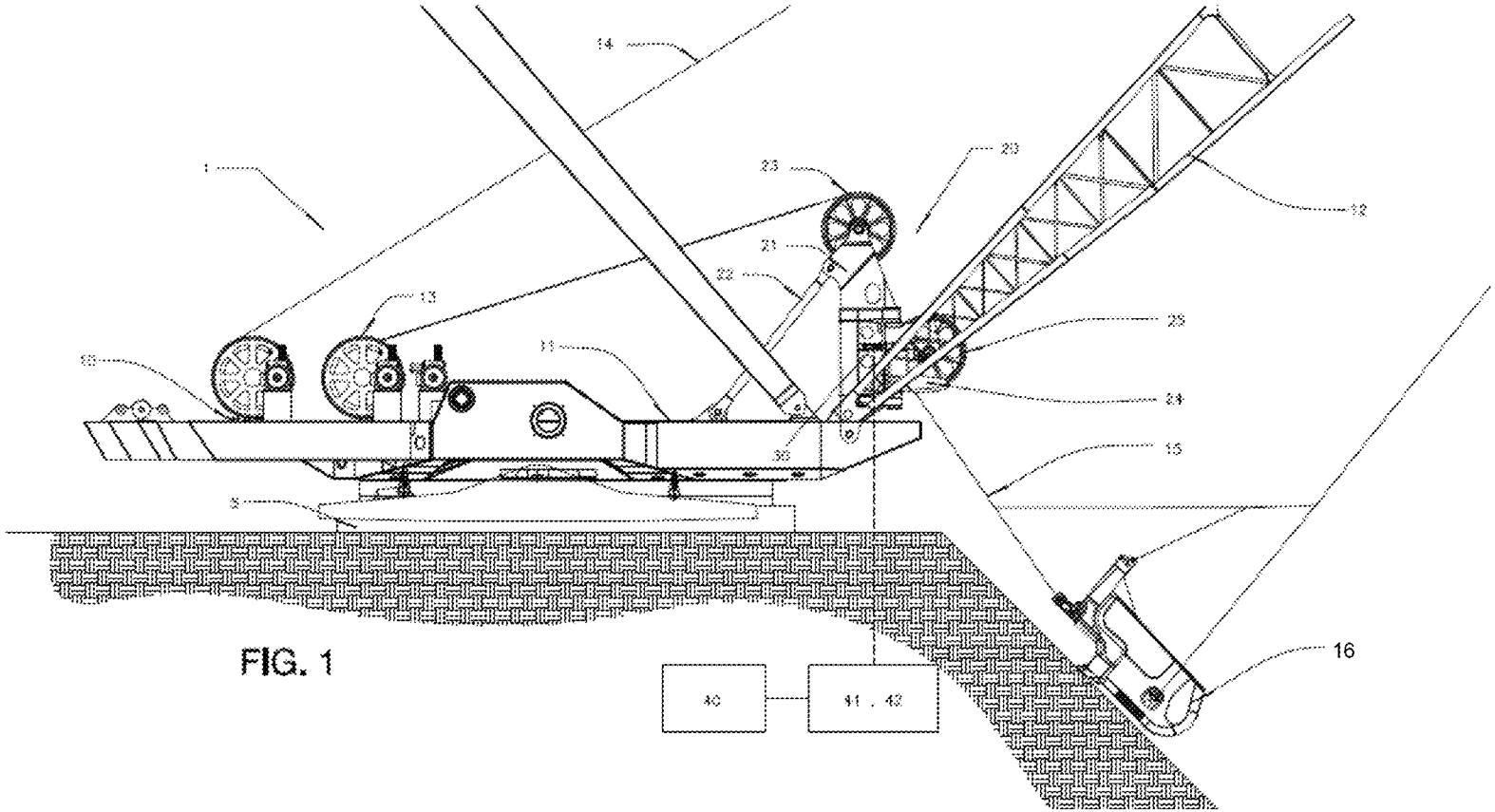
FIG. 1 is an elevational view of a dragline according to an embodiment of the invention.

FIG. 1 illustrates a dragline 1 including a base 5, which may be in the form of a treaded drive-mechanism or walking tub, and a main housing 10 which is free to rotate and supported above the base 5. The main housing includes a generally horizontal, upwardly facing surface 11. A boom 12 extends from the surface 11 of the main housing 10 and supports a bucket 16. A cable drum 13 stores drag cable 15 used to horizontally support the bucket 16. In combination with the boom 12, a series of sheaves, guides, and cables (including hoist ropes 14 and the drag ropes 15) are used to maneuver the bucket 16 along the ground for excavating and mining operations.

One mechanism on the dragline 1 that is used to dampen the oscillations of drag ropes 15 on a dragline 1 is a fairlead 20, shown in FIGS. 1-2. In heavy earth-moving machines such as draglines 1, a fairlead 20 is used to smoothly guide a line, rope, or cable around a vertical change of direction. A fairlead 20 also provides an intermediate vertical support on a long straight run of heavy line, rope or cable to minimize deflection and vibration.

Figure 2A:
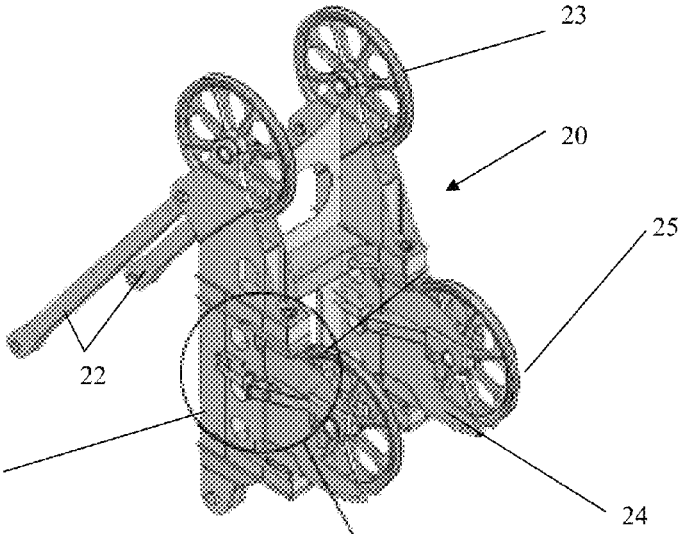
FIG. 2*a* is a perspective (isometric) view of the dragline fairlead of FIG. 1
Figure 2B:
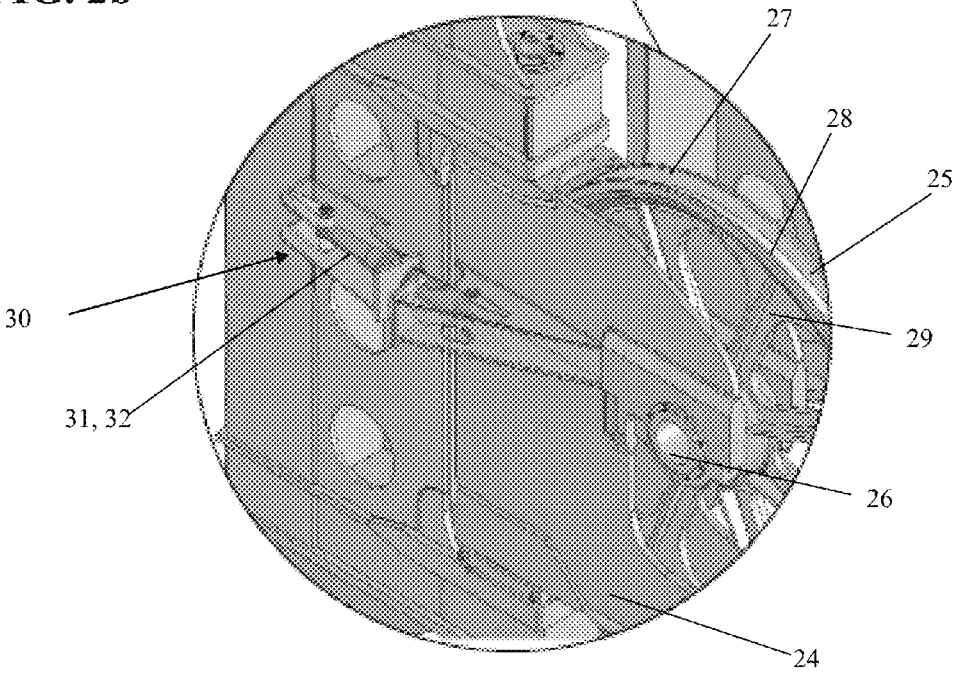
FIG. 2*b* is an enlarged view of a portion of FIG. 2*a*.

As best shown in FIGS. 2*a* and 2*b*, the fairlead 20 is defined by a fixed tower 21 and is secured to the surface 11 of the main housing 10 in part by a compression strut 22. The fairlead tower 21 includes a pair of upper tower sheaves 23 that guide the drag rope 15 from the drum 13. The upper sheaves 23 guide the drag ropes 15 downwards respectively towards a pair of swivel frame 24. The swivel frames 24 are allowed to independently rotate relative to the tower 21 to follow the direction of two respective drag ropes 15 attached to the bucket 16 as they pay in towards the dragline 1 while filling the bucket 16 during digging, pay out from the dragline 1 during lifting the full bucket 16 to the dump position, and then pay out while lowering the bucket 16 back to the dig position. During these digging, lifting and lowering modes, the bucket 16 moves laterally from the centerline of the dragline 1 due to the uneven digging resistance of the material being dug, as well as the inertial loads applied to the bucket 16 while swinging the dragline 1 to the dump position, or back to the dig position.

With continued reference to FIGS. 2*a* and 2*b*, mounted within each swivel frame 24 is at least one swivel sheave 25 to guide the drag rope 15 (which may be in the form of wire rope). Each swivel sheave 25 includes a hub 26 defining an axis, a rim 27 defining at least one circumferentially extending groove 28, and two plates 29 oriented substantially perpendicular to the axis, each plate 29 connected to the hub 26 and to the rim 27. The purpose of the rotating action of the swivel frames 24 is to allow the drag ropes 15 to follow the lateral movement of the bucket 16 during the digging mode of the dragline 1 without causing undue lateral stress on the drag ropes 15.

In an exemplary embodiment, electronically controlled dynamic dampening is provided to the wire rope forming the drag rope 15 through a mechanism 30 including a hydraulic strut 31 installed between the swivel frame 24 and the fairlead tower 21. In one embodiment, magnetic rheology is utilized to modify the effective dampening characteristics of the fairlead swivel frames 24. An advantage of magnetic rheology is its simplicity and that it provides for a theoretically infinite range of highly responsive dampening. Using magnetic rheology, the viscosity of a dampening fluid disposed within the strut 31 can be varied from its nominal viscosity to a near-solid by the application of an external magnetic field via an electric current. By incorporating magnetic rheology technology with a specialized electronic motion control algorithm, an optimum dampening result is achieved throughout the entire operating range of the fairlead 20, thus maximizing drag rope 15 life through minimization of wire rope excursion The dynamic dampening mechanism 30 (also referred to as "damper") limits the rotation of the swivel frames 24 and minimizes damage to the dragline ropes 15 and the structure of the fairlead 20. The dampers 30 may be, for example, double acting hydraulic struts 31 that are attached between the swivel frames 24 and the fairlead tower 21. The dampers 30 may be placed on both lateral sides of each of the swivel frames 24, or on either side of the swivel frames 24 depending on the required level of damping. In one embodiment, the damper 30 may include a steel-walled cylinder 32 that is precisely machined having a piston therein that is capped and sealed along with a dampening fluid that includes ferrous particles suspended therein. The viscous fluid could be, for example, mineral oils, glycol, or synthetic oils which contain 20-40% iron particles by volume.

The damper 30 automatically adjusts the damping function based on the operating conditions of the dragline 1 using external devices, such as a controller 40, sensors 41, and monitors 42. The controller 40 may include a computer, cellular phone, or another device, and may be located on the main housing 10 or may be located remotely. In one embodiment, a series of sensors 41 and monitors 42 measure a test force on the damper 30 to determine the precise velocity and force to be absorbed by the damper 30. After obtaining this information, an algorithm calculates the magnitude of the magnetic field of the viscous fluid to a predetermined value to absorb the energy within the damper 30.

The level of damping required is highly dependent on the actual digging conditions and the skill of the operator of the dragline 1. These two factors are highly variable in any given situation, which is one reason why a damping system that is easily adjustable with an external device is desirable. The use of magnetic rheology to modify the hydraulic damping characteristics in real time with adaptive control software allows optimization of the actual damping characteristics based on the varying conditions being experienced during actual operation.

Conventionally, in the positional mode, the effort to minimize the effect of standing wave vibration on the wrapping of the wire rope on a drum or a sheave, limit the excursion of the wire rope in this vibratory mode, and facilitate the approach (fleeting) angle for the wire rope is achieved through mechanical rope guides mounted to both dampen the magnitude of the oscillation and facilitate the proper fleeting angle of the rope to the drum. The proper dampening associated with fairlead sheaves may be achieved by either or a combination of the inherent design of the mounting/orientation (utilizing the mass of the sheaves and gravity) and/or a hydraulic dampener. This design concept can be statically "tuned" to provide the proper dampening for a fixed operating condition. However, an inherent problem is that there is not a "fixed" operation in practice. Therefore, any over compensation leads to rope life reduction due to bending fatigue and/or abrasion. Any under compensation leads to excessive wire rope excursion and its consequential effects.

Thus, in exemplary embodiments of the present invention, in the positional mode, the dynamic dampening is applied to the fairlead assembly 20 which allows for the translational movement and guidance of the wire rope 15. In the positional mode, the dynamic dampening system is installed so as to provide dynamic control of both swivel frames 24 by providing a dampening device between the two frames 24, using each frame as a reactionary support to dampen oscillations. In an alternative embodiment, an independent dampening device may be installed between each fairlead swivel frame 24 and a stationary part of the fairlead tower 21. As such, the dampening mechanism 30 is disposed to communicate between the moveable fairlead swivel frames 24 and the stationary tower 21 suitable to resist the kinetic energy of the fairlead 1.

Figure 3:
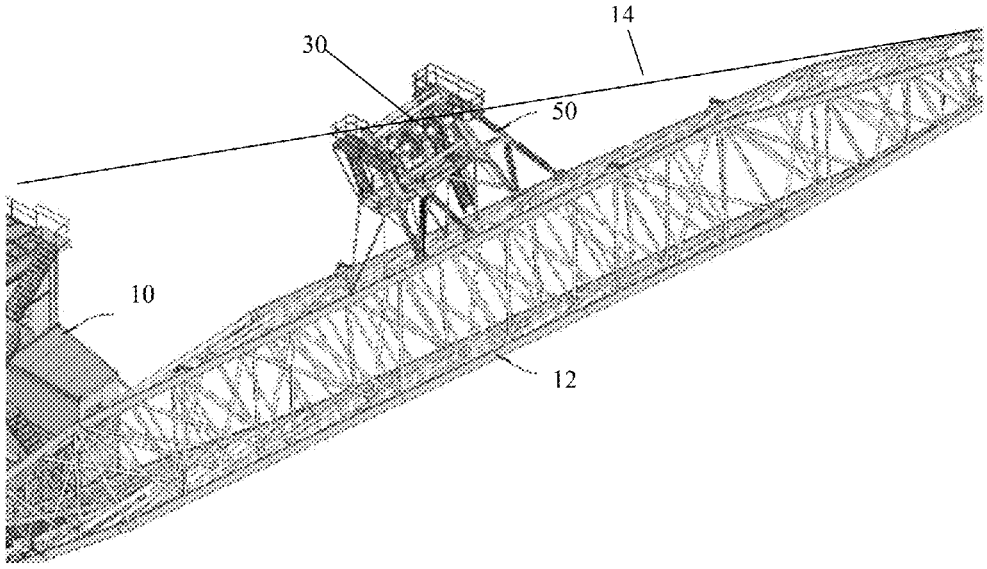
FIG. 3 is a partial perspective view of a dragline including a hoist guide sheave tower.

In the suspension mode, the dynamic dampening mechanism 30 may be applied, for example, in a hoist rope sheave tower 50 as shown in FIG. 3. Due to the response required to achieve dynamic dampening throughout the operating range of the equipment and the inherently slow nature of a mechanical control system, exemplary embodiments of the present invention utilize electrical control of a dynamic dampener in the hoist rope sheave tower 50 to control vertical oscillations of the hoist ropes.

Although the foregoing description refers specifically to a dragline, it should be appreciated that the dynamic damping control mechanism discussed herein may be used in other applications such as power shovels, cranes, and the like which experience wire rope excursions. Thus, variations and modifications exist within the scope and spirit of one or more independent aspects of the invention as described.

The invention claimed is:

1. A machine comprising:

a base;

a main housing that is rotatable and supported on the base, the main housing including a generally horizontal surface;

a drum mounted on said main housing;

a boom extending from said main housing;

a bucket operatively connected to and supported by the boom;

a wire rope extending between the drum and the bucket for movement of the bucket;

a fairlead disposed on the main housing along a path of the wire rope, the wire rope passing through the fairlead between the drum and the bucket; and a dynamic dampening mechanism disposed on the fairlead, the dynamic dampening mechanism including a dampening fluid having a variable viscosity in response to an electrical current applied thereto.

2. The machine of claim 1, wherein the dynamic dampening mechanism includes at least one hydraulic strut.

3. The machine of claim 2, further comprising a controller that electronically controls the amount of the electrical current applied to the dampening fluid to change the viscosity of the dampening fluid.

4. The machine of claim 3, wherein the controller automatically changes the viscosity of the dampening fluid in real time in response to changing load conditions as experienced by the dynamic dampening mechanism.

5. The machine of claim 3, wherein the dynamic dampening mechanism includes a plurality of struts, the electrical current applied to each of the struts being controlled independently by the controller.

6. The machine of claim 2, wherein the fairlead includes two independent fairlead swivel frames which are freely rotatable.

7. The machine of claim 6, wherein each of the swivel frames include at least one sheave to guide the wire rope.

8. The machine of claim 7, wherein each sheave includes:

a hub defining an axis;

a rim defining at least one circumferentially extending groove; and two plates oriented substantially perpendicular to the axis, each plate connected to the hub and to the rim.

9. The machine of claim 6, wherein the strut is disposed on both lateral sides of the swivel frame.

10. The machine of claim 1, wherein the dynamic dampening mechanism includes a piston.

11. The machine of claim 6, wherein the strut is disposed between the two swivel frames.

12. The machine of claim 1, wherein the dampening fluid includes iron.

13. The machine of claim 1, wherein the dampening fluid includes 20-40% iron particles by volume.

14. The machine of claim 10, further comprising a second dynamic dampening mechanism operatively connected to the boom to control vertical oscillations of the hoist rope.

15. The machine of claim 1, wherein the wire rope includes drag rope for horizontal movement of the bucket and hoist rope for vertical movement of the bucket.

16. The machine of claim 1, wherein the machine is a dragline.

17. A machine comprising:

a base;

a main housing that is freely rotatable and supported on the base, the main housing including a generally horizontal, upwardly facing surface;

a drum mounted on said main housing;

a boom extending from said main housing;

a bucket operatively connected to and supported by the boom;

a drag rope extending between the drum and the bucket for horizontal movement of the bucket;

a fairlead disposed on the main housing along a path of the wire rope, the drag rope passing through the fairlead between the drum and the bucket;

a dynamic dampening mechanism disposed on the fairlead, the dynamic dampening mechanism including at least one hydraulic strut with a dampening fluid having a variable viscosity in response to an electrical current applied thereto; and a controller that electronically controls the amount of the electrical current applied to the dampening fluid to change the viscosity of the dampening fluid.

18. The machine of claim 17, wherein the fairlead includes two independent fairlead swivel frames which are rotatable.

* * * * *